US006217428B1

(12) United States Patent
Paisar

(10) Patent No.: US 6,217,428 B1
(45) Date of Patent: Apr. 17, 2001

(54) GRINDING DISC HOLDER

(76) Inventor: Richard Paisar, 104 Riverview Dr., Marion, WI (US) 54950

( * ) Notice: Subject to any disclaimer, the term of this patent is extended or adjusted under 35 U.S.C. 154(b) by 0 days.

(21) Appl. No.: 09/314,916

(22) Filed: May 20, 1999

(51) Int. Cl.[7] ..... B24B 41/06
(52) U.S. Cl. ..... 451/365; 451/491
(58) Field of Search ..... 451/365, 364, 451/458, 359, 490, 491, 451; 248/125.1, 149, 161, 132; 206/307.1, 445, 449

(56) References Cited

U.S. PATENT DOCUMENTS 4,926,722 * 5/1990 Sorensen et al. ..... 81/487
4,948,076 * 8/1990 Sumrell et al. ..... 248/125
5,454,551 * 10/1995 Hobday ..... 269/6

* cited by examiner

*Primary Examiner*—Timothy V. Eley
*Assistant Examiner*—Dung Van Nguyen

(57) ABSTRACT

A grinding disc holder for holding and dispensing paper backed abrasive grinding discs. The grinding disc holder includes a base plate and a top plate spaced above the base plate. A spaced apart pair of support rods are extended between the base plate and the top plate. A slide bar is extended between the base plate and the top plate. A clamp plate is interposed between the base plate and the top plate. The clamp plate is positioned between the support rods and the slide bar. A jaw assembly is slidably mounted on the slide bar to permit sliding of the jaw assembly along the slide bar between the base plate and the top plate. The jaw assembly has a sub-assembly for releasably holding the jaw assembly in a fixed positioned on the slide bar. The jaw assembly also has a jaw portion coupled to the clamp plate such that sliding of the jaw assembly along the slide bar in turn moves the clamp plate between the base plate and the top plate.

9 Claims, 2 Drawing Sheets

GRINDING DISC HOLDER

BACKGROUND OF THE INVENTION

1. Field of the Invention

The present invention relates to grinding disc holders and more particularly pertains to a new grinding disc holder for holding and dispensing paper backed abrasive grinding discs.

2. Description of the Prior Art

The use of grinding disc holders is known in the prior art. More specifically, grinding disc holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,294,357; 4,875,609; 4,926,722; 5,454,551; Des. 387,943; and 3,096,975 which are all incorporated by reference herein.

While these devices fulfill their respective, particular objectives and requirements, the aforementioned patents do not disclose a new grinding disc holder. The inventive device includes a base plate and a top plate spaced above the base plate. A spaced apart pair of support rods are extended between the base plate and the top plate. A slide bar is extended between the base plate and the top plate. A clamp plate is interposed between the base plate and the top plate. The clamp plate is positioned between the support rods and the slide bar. A jaw assembly is slidably mounted on the slide bar to permit sliding of the jaw assembly along the slide bar between the base plate and the top plate. The jaw assembly has a sub-assembly for releasably holding the jaw assembly in a fixed positioned on the slide bar. The jaw assembly also has a jaw portion coupled to the clamp plate such that sliding of the jaw assembly along the slide bar in turn moves the clamp plate between the base plate and the top plate.

In these respects, the grinding disc holder according to the present invention substantially departs from the conventional concepts and designs of the prior art, and in so doing provides an apparatus primarily developed for the purpose of holding and dispensing paper backed abrasive grinding discs.

SUMMARY OF THE INVENTION

In view of the foregoing disadvantages inherent in the known types of grinding disc holders now present in the prior art, the present invention provides a new grinding disc holder construction wherein the same can be utilized for holding and dispensing paper backed abrasive grinding discs.

The general purpose of the present invention, which will be described subsequently in greater detail, is to provide a new grinding disc holder apparatus and method which has many of the advantages of the grinding disc holders mentioned heretofore and many novel features that result in a new grinding disc holder which is not anticipated, rendered obvious, suggested, or even implied by any of the prior art grinding disc holders, either alone or in any combination thereof.

To attain this, the present invention generally comprises a base plate and a top plate spaced above the base plate. A spaced apart pair of support rods are extended between the base plate and the top plate. A slide bar is extended between the base plate and the top plate. A clamp plate is interposed between the base plate and the top plate. The clamp plate is positioned between the support rods and the slide bar. A jaw assembly is slidably mounted on the slide bar to permit sliding of the jaw assembly along the slide bar between the base plate and the top plate. The jaw assembly has a sub-assembly for releasably holding the jaw assembly in a fixed positioned on the slide bar. The jaw assembly also has a jaw portion coupled to the clamp plate such that sliding of the jaw assembly along the slide bar in turn moves the clamp plate between the base plate and the top plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new grinding disc holder apparatus and method which has many of the advantages of the grinding disc holders mentioned heretofore and many novel features that result in a new grinding disc holder which is not anticipated, rendered obvious, suggested, or even implied by any of the prior art grinding disc holders, either alone or in any combination thereof.

It is another object of the present invention to provide a new grinding disc holder which may be easily and efficiently manufactured and marketed.

It is a further object of the present invention to provide a new grinding disc holder which is of a durable and reliable construction.

An even further object of the present invention is to provide a new grinding disc holder which is susceptible of a low cost of manufacture with regard to both materials and labor, and which accordingly is then susceptible of low prices of sale to the consuming public, thereby making such grinding disc holder economically available to the buying public.

Still yet another object of the present invention is to provide a new grinding disc holder which provides in the apparatuses and methods of the prior art some of the advantages thereof, while simultaneously overcoming some of the disadvantages normally associated therewith.

Still another object of the present invention is to provide a new grinding disc holder for holding and dispensing paper backed abrasive grinding discs.

Yet another object of the present invention is to provide a new grinding disc holder which includes a base plate and a top plate spaced above the base plate. A spaced apart pair of support rods are extended between the base plate and the top plate. A slide bar is extended between the base plate and the top plate. A clamp plate is interposed between the base plate and the top plate. The clamp plate is positioned between the support rods and the slide bar. A jaw assembly is slidably mounted on the slide bar to permit sliding of the jaw assembly along the slide bar between the base plate and the top plate. The jaw assembly has a sub-assembly for releasably holding the jaw assembly in a fixed positioned on the slide bar. The jaw assembly also has a jaw portion coupled to the clamp plate such that sliding of the jaw assembly along the slide bar in turn moves the clamp plate between the base plate and the top plate.

Still yet another object of the present invention is to provide a new grinding disc holder that keeps the grinding discs flat and prevents them from curling due to moisture such as humidity.

Even still another object of the present invention is to provide a new grinding disc holder that allows a user to store and carry a stack of grinding discs in a compact and organized manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
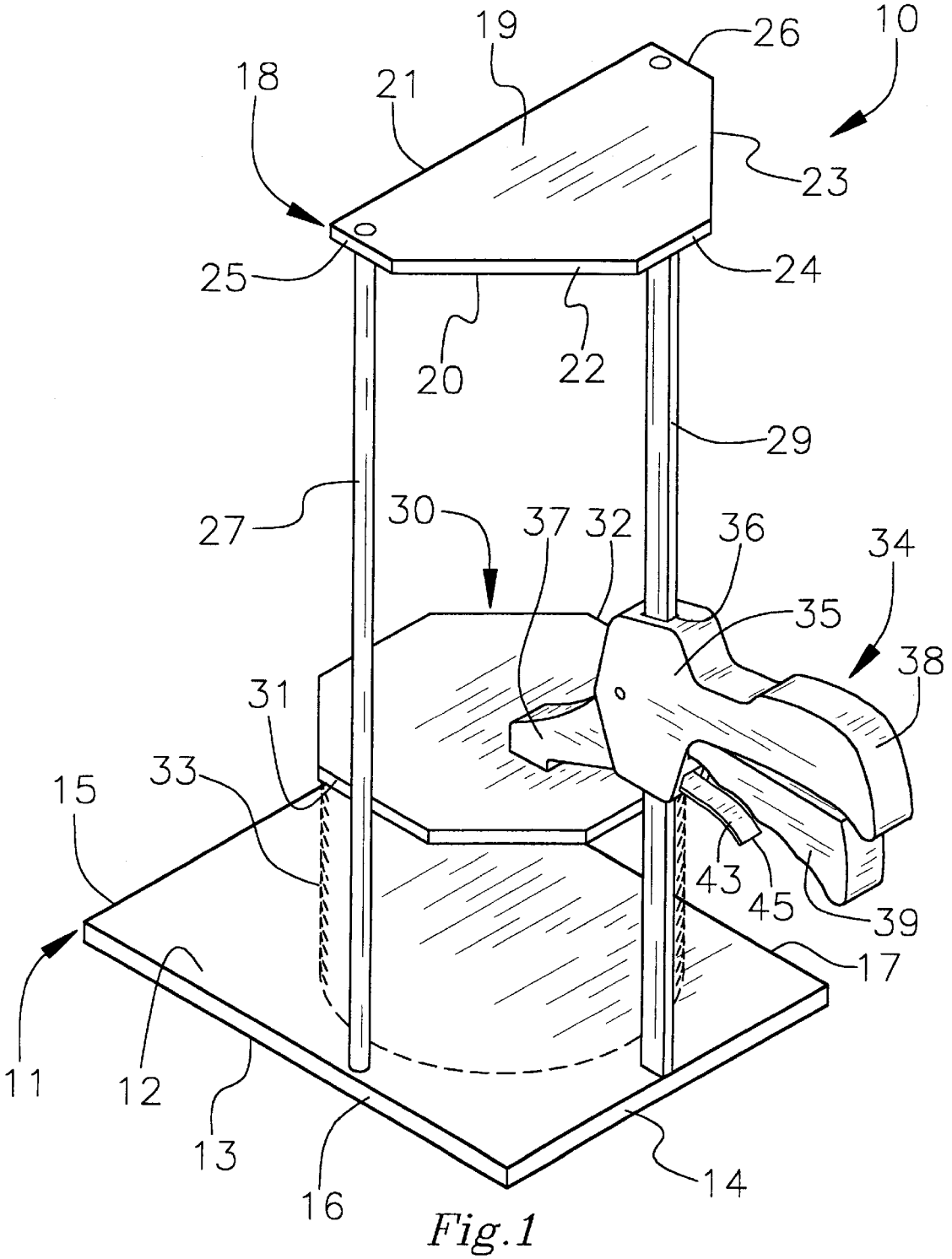
FIG. 1 is a schematic perspective view of a new grinding disc holder according to the present invention.
Figure 2:
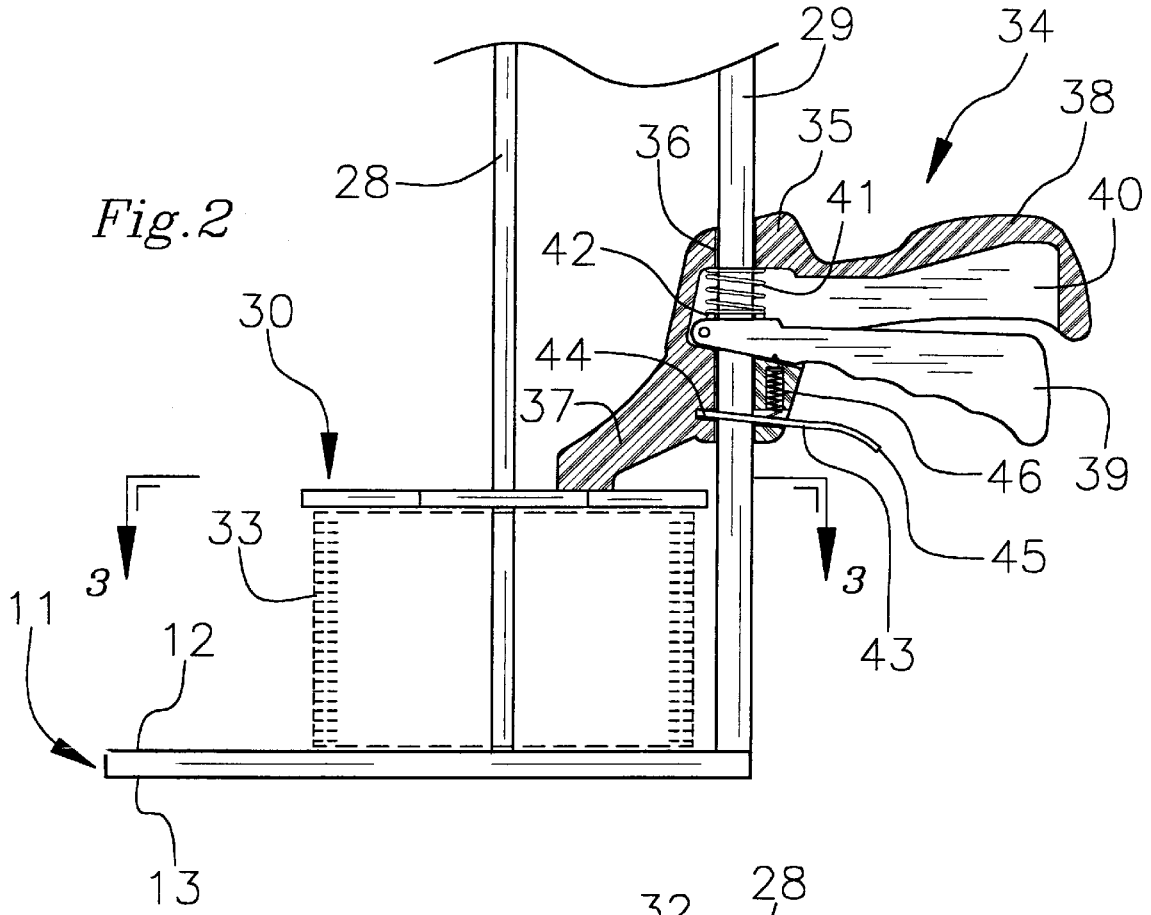
FIG. 2 is a schematic partial cross sectional side view of the present invention.
Figure 3:
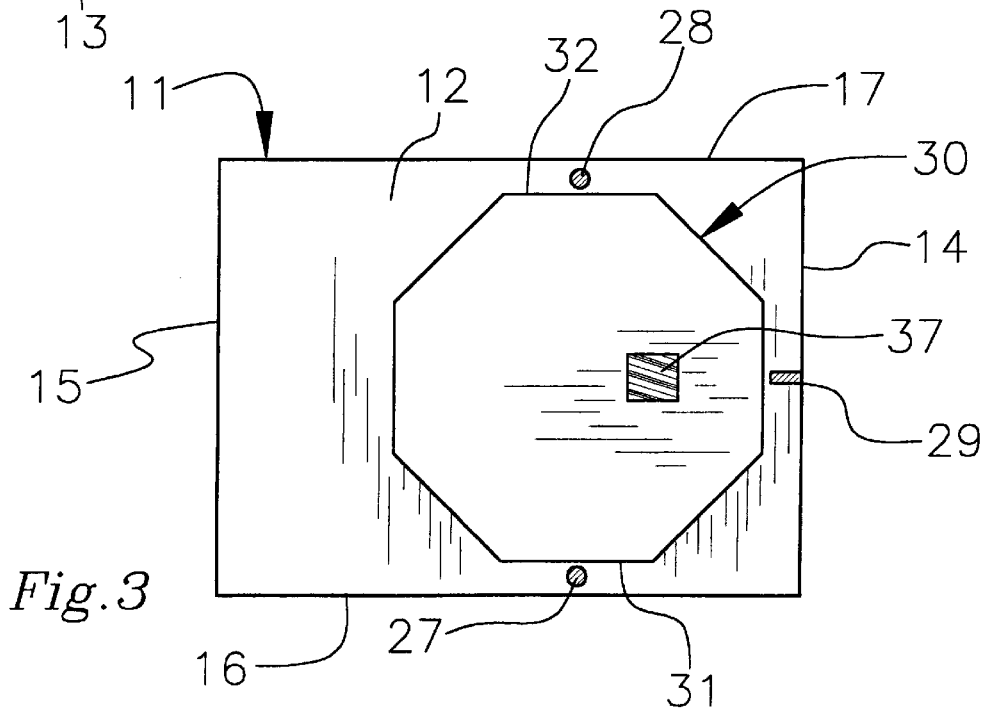
FIG. 3 is a schematic cross sectional view of the present invention taken from line 3—3 of FIG. 2.

With reference now to the drawings, and in particular to FIGS. 1 through 3 thereof, a new grinding disc holder embodying the principles and concepts of the present invention and generally designated by the reference numeral 10 will be described.

As best illustrated in FIGS. 1 through 3, the grinding disc holder 10 generally comprises a base plate and a top plate spaced above the base plate. A spaced apart pair of support rods are extended between the base plate and the top plate. A slide bar is extended between the base plate and the top plate. A clamp plate is interposed between the base plate and the top plate. The clamp plate is positioned between the support rods and the slide bar. A jaw assembly is slidably mounted on the slide bar to permit sliding of the jaw assembly along the slide bar between the base plate and the top plate. The jaw assembly has a sub-assembly for releasably holding the jaw assembly in a fixed positioned on the slide bar. The jaw assembly also has a jaw portion coupled to the clamp plate such that sliding of the jaw assembly along the slide bar in turn moves the clamp plate between the base plate and the top plate.

In use, the holder 10 is designed for holding a stack of paper backed abrasive grinding discs having a sandpaper-like abrasive face so that the stack is not easily knocked over and easy for a user to transport from one work location to another.

In closer detail, the holder 10 comprises a generally rectangular base plate 11 designed for resting on a surface. The base plate has substantially planar generally rectangular upper and lower faces 12,13, and a generally rectangular outer perimeter comprising a pair of substantially parallel end edges 14,15 and a pair of substantially parallel side edges 16,17 extending substantially perpendicular of the end edges of the base plate. In an ideal illustrative embodiment, the base plate has a length defined between the end edges of the base plate of about 12 inches and a width defined between the side edges of the base plate of about 9 inches.

A generally triangular top plate 18 is spaced above the base plate. Preferably, the top plate is spaced above the base plate between preferably between 12 inches and 24 inches. In an ideal illustrative embodiment, the top plate is spaced above the base plate between about 16 inches and about 20 inches. The top plate has substantially planar upper and lower faces 19,20, and a generally triangular outer perimeter comprising three side edges 21,22,23 and three flattened corners 24,25,26.

The base plate and the top plate lie in substantially parallel planes to one another with the lower face of the top plate facing downwards towards the upper face of the base plate.

A first of the flattened corners 24 of the top plate is positioned towards a first of the end edges 14 of the base plate. The first flattened corner of the top plate is extended substantially parallel to the first end edge of the base plate. Ideally, the first flattened corner of the top plate and the first end edge of the base plate lie in a common vertical plane.

A second of the flattened corners 25 of the top plate is positioned towards a first of the side edges 16 of the base plate. The second flattened corner of the top plate is extended substantially parallel to the first side edge of the base plate. A third of the flattened corners 26 of the top plate is positioned towards a second of the side edges 17 of the base plate. The third flattened corner of the top plate is extended substantially parallel to the second side edge of the base plate.

A first of the side edges 21 of the top plate is extended between the second and third flattened corners 25,26 of the top plate. The first side edge of the top plate is positioned towards a second of the end edges 15 of the base plate. The first side edge 21 of the top plate is extended substantially parallel to the second end edge 15 of the base plate.

A spaced apart pair of substantially parallel elongate support rods 27,28 are extended between the base plate and the top plate to support the top plate above the base plate. The support rods each have opposite top and bottom ends and a longitudinal axis extending between the top and bottom ends of the respective support rod. The support rods each preferably have a generally circular transverse cross section taken in a plane substantially perpendicular to the longitudinal axis of the respective support rod. The bottom ends of the support rods are coupled to the base plate. The top ends of the support rods is coupled to the top plate. One of the side rods is positioned adjacent the first side edge of the base plate and the second flattened corner of the top plate. The other of the side rods is positioned adjacent the second side edge of the base plate and the third flattened corner of the top plate. The longitudinal axes of the support rods are extended substantially parallel to one another and substantially perpendicular to the base plate and the top plate.

An elongate slide bar 29 is extended between the base plate and the top plate. The slide bar is positioned adjacent the first end edge of the base plate and the first flattened corner of the top plate. The slide bar has upper and lower ends, and a longitudinal axis extending between the upper and lower ends of the slide bar. Preferably, the slide bar has a generally rectangular transverse cross section taken in a plane substantially perpendicular to the longitudinal axis of the slide bar. The lower end of the slide bar is coupled to the base plate adjacent the first end edge of the base plate and the upper end of the slide bar is coupled to the top plate adjacent the first flattened corner of the top plate.

A generally octagonal clamp plate 30 is interposed between the base plate and the top plate so that the clamp plate is positioned between the support rods and the slide bar. The clamp plate has substantially planar generally octagonal top and bottom faces, and a generally octagonal outer perimeter comprises eight sides. The top face of the clamp plate faces upwards towards the lower face of the top plate and the bottom face of the clamp plate faces downwards towards the upper face of the base plate. As best illustrated in FIG. 3, a first of the sides 31 of the clamp plate is positioned adjacent one of the side rods and a second of the sides 32 of the clamp plate located opposite the first side of the clamp plate is positioned adjacent the other of the support rods. The first and second sides of the clamp plate are preferably extended substantially parallel to the side edges of the base plate. As best illustrated in FIGS. 1 and 2, the upper face of the base plate and the bottom face of the clamp plate are designed for positioning a generally cylindrical stack of generally circular grinding discs 33 therebetween.

A quick release movable jaw assembly 34 is slidably mounted on the slide bar to permit sliding of the movable jaw assembly along the slide bar between the base plate and the top plate. The movable jaw assembly is of the type similar to that taught in U.S. Pat. No. 4,926,722 by Sorensen et al. entitled "Quick-Action Bar Clamp" which, as mentioned above, is incorporated by reference herein. The movable jaw assembly comprises a body portion 35 having a slot 36 therethrough. The slide bar is extended through the slot to permit sliding of the body portion along the slide bar.

The jaw assembly also includes a jaw portion 37 extending from the body portion in a direction towards the second end edge of the base plate. The jaw portion has an end opposite the body portion coupled to the upper face of the clamp plate such that sliding of the jaw assembly along the slide bar in turn moves the clamp plate between the base plate and the top plate.

The jaw assembly further includes a handgrip portion 38 extending from the body portion opposite the jaw portion. The handgrip portion is outwardly extended in a direction away from the first end edge of the base plate. A trigger 39 is pivotally coupled to the body portion adjacent the slot of the body portion. The handgrip portion has a cavity 40 for receiving the trigger. The cavity of the handgrip portion is in communication with the slot of the body portion. A first coiled compression spring 41 is disposed around the slide bar and positioned in cavity between the trigger and an upper region of the body portion. The spring biases the trigger downwards out of the cavity. A driving lever 42 is disposed around the slide bar between the first spring and the trigger.

The jaw assembly also includes a braking lever 43 having an opening therethrough through which the slide bar is extended. The braking lever has a first end 45 pivotally captured in a recess in the body portion and a second end 44 outwardly extending from the body portion such that the trigger is positioned between the handgrip portion and the second end of the braking lever. A second coiled compression spring 46 is coupled to the trigger and the braking lever. The second spring biases the braking lever away from the trigger. In use, the second spring biases the braking lever to a position where the side of the opening of the braking lever engages the slide bar to prevent sliding of the jaw assembly along the slide bar, Moving the braking lever towards the trigger disengages the slide bar from the side of the opening of the braking lever to permit sliding of the jaw assembly up and down along the slide bar. Squeezing the trigger allows incremental movement of the jaw assembly in a downwards direction towards the base plate by pivoting the driving lever to a position where it engages the slide bar and upon release of the trigger moves the jaw assembly down an increment on the slide bar.

In use, a stack of grinding discs are positioned between the base plate and the clamp plate. The jaw assembly is used to hold the stack of grinding discs between the base plate and the clamp plate. To remove a grinding disc, the jaw assembly is operated to disengage from the slide bar to permit sliding upwards of the jaw assembly and thus move the clamp plate upwards to permit a user to remove a grinding disc from the top of the stack. After the grinding disc is removed, the jaw assembly may be slid down to clamp the stack of remaining grinding discs between the base plate and the clamp plate.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A holder for holding a stack of grinding discs, said holder comprising:

a base plate;

a top plate being spaced above said base plate;

a spaced apart pair of support rods being extended between said base plate and said top plate;

a slide bar being extended between said base plate and said top plate;

a clamp plate being interposed between said base plate and said top plate, said clamp plate being positioned between said support rods and said slide bar;

a jaw assembly being slidably mounted on said slide bar to permit sliding of said jaw assembly along said slide bar between said base plate and said top plate;

said jaw assembly having a sub-assembly for releasably holding said jaw assembly in a fixed positioned on said slide bar; and said jaw assembly having a jaw portion coupled to said clamp plate such that sliding of said jaw assembly along said slide bar in turn moves said clamp plate between said base plate and said top plate.

2. The holder of claim 1, wherein said base plate has substantially planar generally rectangular upper and lower faces, and a generally rectangular outer perimeter comprising a pair of substantially parallel end edges and a pair of substantially parallel side edges extending substantially perpendicular of said end edges of said base plate.

3. The holder of claim 2, wherein said top plate has substantially planar upper and lower faces, and a generally triangular outer perimeter comprising three side edges and three flattened corners.

4. The holder of claim 3, wherein a first of said flattened corners of said top plate is positioned towards a first of said end edges of said base plate, wherein said first flattened corner of said top plate is extended substantially parallel to said first end edge of said base plate, wherein a second of said flattened corners of said top plate is positioned towards a first of said side edges of said base plate, wherein said second flattened corner of said top plate is extended substantially parallel to said first side edge of said base plate, wherein a third of said flattened corners of said top plate is positioned towards a second of said side edges of said base plate, and wherein said third flattened corner of said top plate is extended substantially parallel to said second side edge of said base plate.

5. The holder of claim 4, wherein a first of said side edges of said top plate is extended between said second and third flattened corners of said top plate, wherein said first side edge of said top plate is positioned towards a second of said end edges of said base plate, and wherein said first side edge of said top plate is extended substantially parallel to said second end edge of said base plate.

6. The holder of claim 1, wherein said jaw assembly comprises a body portion having a slot therethrough, said slide bar being extended through said slot to permit sliding of said body portion along said slide bar, wherein said jaw assembly further comprises a handgrip portion extending from said body portion opposite said jaw portion, said handgrip portion being outwardly extended in a direction away from said first end edge of said base plate, said jaw assembly further including a trigger pivotally coupled to said body portion adjacent said slot of said body portion, said handgrip portion having a cavity for receiving said trigger, said cavity of said handgrip portion being in communication with said slot of said body portion.

7. The holder of claim 6, wherein a first spring is disposed around said slide bar and positioned in cavity between said trigger and an upper region of said body portion, said spring biasing said trigger downwards out of said cavity, wherein said jaw assembly further comprises a braking lever having an opening therethrough, said slide bar being extended through said opening of said braking lever, said braking lever having a first end pivotally captured in a recess in said body portion and a second end outwardly extending from said body portion such that said trigger is positioned between said handgrip portion and said second end of said braking lever and wherein a second spring is coupled to said trigger and said braking lever, said second spring biasing said braking lever away from said trigger.

8. A holder for holding a stack of grinding discs, said holder comprising:

a generally rectangular base plate having substantially planar generally rectangular upper and lower faces, and a generally rectangular outer perimeter comprising a pair of substantially parallel end edges and a pair of substantially parallel side edges extending substantially perpendicular of said end edges of said base plate;

wherein said base plate has a length defined between said end edges of said base plate of about 12 inches and a width defined between said side edges of said base plate of about 9 inches;

a generally triangular top plate being spaced above said base plate;

wherein said top plate is spaced above said base plate between about 12 inches and about 24 inches said top plate having substantially planar upper and lower faces, and a generally triangular outer perimeter comprising three side edges and three flattened corners;

said base plate and said top plate lying in substantially parallel planes to one another;

said lower face of said top plate facing downwards towards said upper face of said base plate;

a first of said flattened corners of said top plate being positioned towards a first of said end edges of said base plate, said first flattened corner of said top plate being extended substantially parallel to said first end edge of said base plate;

wherein said first flattened corner of said top plate and said first end edge of said base plate lie in a common plane;

a second of said flattened corners of said top plate being positioned towards a first of said side edges of said base plate, said second flattened corner of said top plate being extended substantially parallel to said first side edge of said base plate;

a third of said flattened corners of said top plate being positioned towards a second of said side edges of said base plate, said third flattened corner of said top plate being extended substantially parallel to said second side edge of said base plate;

a first of said side edges of said top plate being extended between said second and third flattened corners of said top plate, said first side edge of said top plate being positioned towards a second of said end edges of said base plate, said first side edge of said top plate being extended substantially parallel to said second end edge of said base plate;

a spaced apart pair of substantially parallel elongate support rods being extended between said base plate and said top plate to support said top plate above said base plate;

said support rods each having opposite top and bottom ends and a longitudinal axis extending between said top and bottom ends of the respective support rod;

said support rods each having a generally circular transverse cross section taken in a plane substantially perpendicular to said longitudinal axis of said respective support rod;

said bottom ends of said support rods being coupled to said base plate, said top ends of said support rods being coupled to said top plate;

one of said side rods being positioned adjacent said first side edge of said base plate and said second flattened corner of said top plate, the other of said side rods being positioned adjacent said second side edge of said base plate and said third flattened corner of said top plate;

said longitudinal axes of said support rods being extended substantially parallel to one another and substantially perpendicular to said base plate and said top plate;

an elongate slide bar being extended between said base plate and said top plate;

said slide bar being positioned adjacent said first end edge of said base plate and said first flattened corner of said top plate;

said slide bar having upper and lower ends, and a longitudinal axis extending between said upper and lower ends of said slide bar;

said slide bar having a generally rectangular transverse cross section taken in a plane substantially perpendicular to said longitudinal axis of said slide bar;

said lower end of said slide bar being coupled to said base plate adjacent said first end edge of said base plate, said upper end of said slide bar being coupled to said top plate adjacent said first flattened corner of said top plate;

a generally octagonal clamp plate being interposed between said base plate and said top plate, said clamp plate being positioned between said support rods and said slide bar;

said clamp plate having substantially planar generally octagonal top and bottom faces, and a generally octagonal outer perimeter comprising eight sides;

said top face of said clamp plate facing upwards towards said lower face of said top plate, said bottom face of said clamp plate facing downwards towards said upper face of said base plate;

a first of said sides of said clamp plate being positioned adjacent one of said side rods and a second of said sides of said clamp plate located opposite said first side of said clamp plate being positioned adjacent said other of said support rods;

said first and second sides of said clamp plate being extended substantially parallel to said side edges of said base plate;

said upper face of said base plate and said bottom face of said clamp plate being adapted for positioning a generally cylindrical stack of generally circular grinding discs therebetween;

a jaw assembly being slidably mounted on said slide bar to permit sliding of said jaw assembly along said slide bar between said base plate and said top plate;

said jaw assembly comprising a body portion having a slot therethrough, said slide bar being extended through said slot to permit sliding of said body portion along said slide bar;

said jaw assembly further comprising a jaw portion extending from said body portion in a direction towards said second end edge of said base plate;

said jaw portion having an end opposite said body portion coupled to said upper face of said clamp plate such that sliding of said jaw assembly along said slide bar in turn moves said clamp plate between said base plate and said top plate;

said jaw assembly further comprising a handgrip portion extending from said body portion opposite said jaw portion, said handgrip portion being outwardly extended in a direction away from said first end edge of said base plate;

said jaw assembly further comprising a trigger pivotally coupled to said body portion adjacent said slot of said body portion;

said handgrip portion having a cavity for receiving said trigger, said cavity of said handgrip portion being in communication with said slot of said body portion;

a first spring being disposed around said slide bar and positioned in cavity between said trigger and an upper region of said body portion, said spring biasing said trigger downwards out of said cavity;

a driving lever being disposed around said slide bar between said first spring and said trigger;

said jaw assembly further comprising a braking lever having an opening therethrough, said slide bar being extended through said opening of said braking lever, said braking lever having a first end pivotally captured in a recess in said body portion and a second end outwardly extending from said body portion such that said trigger is positioned between said handgrip portion and said second end of said braking lever;

a second spring being coupled to said trigger and said braking lever, said second spring biasing said braking lever away from said trigger, said second spring biasing said braking lever to a position where said side of said opening of said braking lever engages said slide bar to prevent sliding of said jaw assembly along said side bar;

wherein moving said braking lever towards said trigger disengages said slide bar from said side of said opening of said braking lever to permit sliding of said jaw assembly up and down along said slide bar, wherein squeezing said trigger allows incremental movement of said jaw assembly in a downwards direction towards said base plate by pivoting said driving lever to a position where it engages said slide bar and upon release of said trigger moves said jaw assembly down an increment on said slide bar;

wherein a stack of grinding discs are positioned between said base plate and said clamp plate;

said jaw assembly is used to hold said stack of grinding discs between said base plate and said clamp plate;

to remove a grinding disc, said jaw assembly is operated to disengage from said slide bar to permit sliding upwards of said jaw assembly and thus move said clamp plate upwards to permit a user to remove a grinding disc from said top of said stack;

after said grinding disc is removed, said jaw assembly may be slid down to clamp said stack of remaining grinding discs between said base plate and said clamp plate.

9. A holder for holding a stack of grinding discs, said holder comprising:

a base plate;

a top plate being spaced above said base plate;

a spaced apart pair of support rods being extended between said base plate and said top plate;

a slide bar being extended between said base plate and said top plate;

a clamp plate being interposed between said base plate and said top plate, said clamp plate being positioned between said support rods and said slide bar;

a jaw assembly being slidably mounted on said slide bar to permit sliding of said jaw assembly along said slide bar between said base plate and said top plate;

said jaw assembly having a sub-assembly for releasably holding said jaw assembly in a fixed positioned on said slide bar;

said jaw assembly having a jaw portion coupled to said clamp plate such that sliding of said jaw assembly along said slide bar in turn moves said clamp plate between said base plate and said top plate;

said jaw assembly comprising a body portion having a slot therethrough, said slide bar being extended through said slot to permit sliding of said body portion along said slide bar, wherein said jaw assembly further comprises a handgrip portion extending from said body portion opposite said jaw portion, said handgrip portion being outwardly extended in a direction away from said first end edge of said base plate, said jaw assembly further including a trigger pivotally coupled to said body portion adjacent said slot of said body portion, said handgrip portion having a cavity for receiving said trigger, said cavity of said handgrip portion being in communication with said slot of said body portion; and a first spring being disposed around said slide bar and positioned in cavity between said trigger and an upper region of said body portion, said spring biasing said trigger downwards out of said cavity, wherein said jaw assembly further comprises a braking lever having an opening therethrough, said slide bar being extended through said opening of said braking lever, said braking lever having a first end pivotally captured in a recess in said body portion and a second end outwardly extending from said body portion such that said trigger is positioned between said handgrip portion and said second end of said braking lever and wherein a second spring is coupled to said trigger and said braking lever, said second spring biasing said braking lever away from said trigger.

* * * * *